US005662012A

United States Patent [19]

Grabovac

[11] Patent Number: 5,662,012

[45] Date of Patent: Sep. 2, 1997

[54] TORQUE WRENCH STRUCTURE

[75] Inventor: Bosko Grabovac, Arcadia, Calif.

[73] Assignee: Consolidated Devices, Inc., City of Industry, Calif.

[21] Appl. No.: 551,799

[22] Filed: Nov. 7, 1995

[51] Int. Cl.[6] ..... B25B 23/159

[52] U.S. Cl. ..... 81/483; 81/467

[58] Field of Search ..... 81/478, 480, 481, 81/483, 467

[56] References Cited

U.S. PATENT DOCUMENTS

| | | | |
|---|---|---|---|
| 2,205,501 | 5/1940 | Sunnen | 81/478 |
| 2,996,940 | 8/1961 | Van Hoose | 81/481 |
| 3,599,515 | 8/1971 | Grabovac | 81/483 |
| 4,485,703 | 12/1984 | Grabovac et al. | 81/483 |
| 4,655,104 | 4/1987 | Blattner | 81/483 |
| 5,394,775 | 3/1995 | Fagerstrom | 81/483 |

*Primary Examiner*—D. S. Meislin
*Assistant Examiner*—Joni B. Danganan
*Attorney, Agent, or Firm*—Emrich & Dithmar

[57] ABSTRACT

An improved and less costly torque wrench adjusting and calibrating structure for accurate axial biasing and adjustment of an elongate axially extending spring in an elongate axially extending tubular lever arm of an adjustable click-type torque wrench. The adjusting means includes a carrier nut securely engaged in the rear end portion of an elongate lever arm and spaced from the rear end of an elongate spring within the arm, an elongate machine screw bolt with a polygonal head within the lever arm between the spring and the carrier nut and an elongate shank engaged through the carrier nut and extending rearwardly from within the lever arm, an axially extending tubular hand grip rotatably carried by and projecting rearwardly from the lever arm, an elongate drive ring with front and rear ends and a central polygonal opening fixed in the grip and surrounding the shank, an elongate polygonal nut with a radially outwardly projecting flange at one end and engaged on the shank and within the ring with its flange engaging the front end thereof, and, a lock nut engaged on the shank and engaging the rear end of the ring.

7 Claims, 3 Drawing Sheets

TORQUE WRENCH STRUCTURE

BACKGROUND OF THE INVENTION

Adjustable click-type torque wrenches have been commercially produced and have been in wide use since the 1950s. The great majority of adjustable click-type torque wrenches provided by the prior art are characterized by elongate tubular lever arms with open front and front ends. Tool (drive socket) engaging heads are pivotally carried at the front ends of the lever arms. The heads carry elongate pivot arms that project rearwardly and freely within the front end portions of the lever arms. The rear ends of the pivot arms are formed with or carry flat rearwardly disclosed front trip block seats. Within the arms and spaced rearward from the front seats are axially movable plungers with flat forwardly disposed trip block rear seats. Trip blocks with flat front and rear faces are positioned between the front and rear trip block seats with their front and rear faces normally occurring in flat seated engagement therewith. Elongate helical compression springs are positioned in the rear end portions of the lever arms and engage and yieldingly urge the plungers forwardly and thereby hold the trip blocks in seated engagement with and between the front and rear seats. The trip blocks normally hold the pivot arms concentric or centrally within the lever arms and spaced radially inward from the inside surfaces of the lever arms. Torsional forces directed onto and through the head of these wrenches cause the pivot arms to pivot. When the torsional forces are sufficient to overcome the forces of the springs acting upon the plungers, the trip blocks are caused to turn or tip out of seated engagement with the seats; urging the plungers rearwardly against the resistance of the springs; and, causing the rear ends of the pivot arms to swing radially within the lever arms and to strike the interior surfaces of the lever arms, creating an audible sound or "click." By selectively varying the extent to which the springs are biased and the forces at which the plungers are urged forwardly, the torsional or forces at which the wrenches actuate to generate their "click" can be accurately adjusted.

To the above end, wrenches of the class here concerned with are provided with adjusting means to effect accurate adjustment of the springs. Typically, the adjusting means include screw mechanisms at the rear end portions of the lever arms. The adjusting means are selectively manually operable to increase and decrease the extent to which the springs are axially biased. The adjusting means further include scales related to the screw mechanisms and the lever arms that indicate the axial position of the rear ends of springs and the extent to which the springs are biased and that translate the positions of the springs into units of force. Further, the adjusting means include calibrating means that enable the positioning of the parts of the adjusting means to be moved and set to properly correlate the positioning of the springs with the scales.

To the best of my knowledge and belief, all of the adjusting means for adjustable click-type wrenches that the prior art provides include at least one and often several extremely costly-to-make machined parts. As a result of the foregoing, adjustable click-type torque wrenches of the character here concerned with and that meet those long-established minimum standards for such tools are costly tools.

Throughout the 1980s, the great majority of adjustable click-type torque wrenches that met the requirements of industry and proved to be commercially successful were patented wrenches produced by several European and United States torque tool manufacturers. Since the mid-1980s, the patents held by the manufacturers of torque wrenches have expired and the special know-how that must be exercised to effectively produce those tools has been acquired by tool manufacturers In several Asian countries including Korea, Taiwan and China. As a result of the foregoing, and because the cost of both material and labor are notably less in those Asian countries than in the United States and in Europe, an ever-increasing number of torque wrenches manufactured in the above-noted Asian countries are appearing in the United States marketplace. Those foreign-made wrenches are identical to those wrenches that have long been made by European and United States tool manufacturers, and their retail prices are well below the cost of manufacture of the identical tools in the United States. As a result of the foregoing, the manufacture of torque wrenches in the United States is becoming unprofitable and the United States manufacturers of such wrenches have or are being forced to discontinue the manufacture of such tools in the United States. As a result of the foregoing, some domestic manufacturers of such tools have gone out of business. Others, with valuable trademarks, goodwill and reputation that will sustain a profitable tool distribution and marketing program have turned to purchasing inexpensive, foreign-made, adjustable click-type torque wrenches and are distributing and selling them as their own manufactured goods,

PRIOR ART

The U.S. patents listed below are cited for their showing of those adjusting and calibrating means for adjustable click-type torque wrenches that the prior art provides.

(1) U.S. Pat. No. 2,704,472 issued Mar. 22, 1955 to R. E. Booth and entitled "Torque Applying Tool With Predetermined Torque Release Means."

(2) U.S. Pat. No. 2,732,747 issued Jan. 31, 1956 to F. W. Livermont and entitled "Predetermined Torque Release Wrench and Spring Adjusting Means Therefor."

(3) U.S. Pat. No. 2,792,733 issued May 21, 1957 to G. M. Walraven, et al., entitled "Pre-set Torque Indicating Wrench."

(4) U.S. Pat. No. 2,887,919 issued May 26, 1959 to S. A. Aijala entitled "Predetermined Torque Release Hand Tool."

(5) U.S. Pat. No. 2,918,834 issued Dec. 29, 1959 to J. W. Cranford entitled "Predetermined Torque Release Wrench."

(6) U.S. Pat. No. 3,016,773 issued Jan. 16, 1962 to R. G. Woods and entitled "Predetermined Torque Release Wrench."

(7) U.S. Pat. No. 3,165,014 issued Jan. 12, 1965 to B. Grabovac and entitled "Predetermined Torque Release Wrench."

(8) U.S. Pat. No. 3,581,606 issued Jun. 1, 1971 to B. Grabovac and entitled "Torque Wrench."

(9) U.S. Pat. No. 3,633,445 issued Jan. 11, 1972 to S. A. Aijala and entitled "Torque Release Handtool."

(10) U.S. Pat. No. 3,772,942, issued Nov. 20, 1973 to B. Grabovac and entitled "Adjustable Torque Wrench."

In each of the above patents, wrenches of the class here concerned with are disclosed. Each of those wrenches is provided with screw means for varying the axial bias of actuating springs and to thereby adjust and set the torsional forces that must be directed through the wrench to cause actuation thereof. Supplemental screw means are included to effect calibration of the wrenches. Each of the above-noted screw means provided by the prior art is characterized by the provision and use of costly-to-make special parts and require the performing of costly machining operation to put them into use.

OBJECTS AND FEATURES OF THE INVENTION

It is an object of my invention to provide an improved adjustable click-type torque wrench structure that is highly durable, accurate and dependable and that is such that it can manufactured and sold throughout the United States at a cost that is less than or competitive with the cost of foreign-made torque wrenches of the same class and the structures of which are copies of prior art torque wrenches of American manufacture.

It is object and a feature of my invention to provide an improved torque wrench structure of the general character referred to above that does not include costly-to-make parts, does not require the performing of any complicated and costly machining operations during its manufacture, and, is easily and quickly assembled without the need of costly tooling and the exercise of special skills.

It is yet another object and feature of my invention to provide an improved adjustable click-type torque wrench of the general character referred to above wherein inexpensive standard bolts and nuts are effectively utilized to replace and perform the functions that were heretofore performed by costly-to-make special parts in those tools of like character provided by the prior art.

The foregoing and other objects and features of my invention will be fully understood from the following detailed description of typical preferred forms and embodiments of my invention throughout which description reference is made to the accompanying drawings.

DETAILED DESCRIPTION OF THE INVENTION

Figures 1, 2, 3:
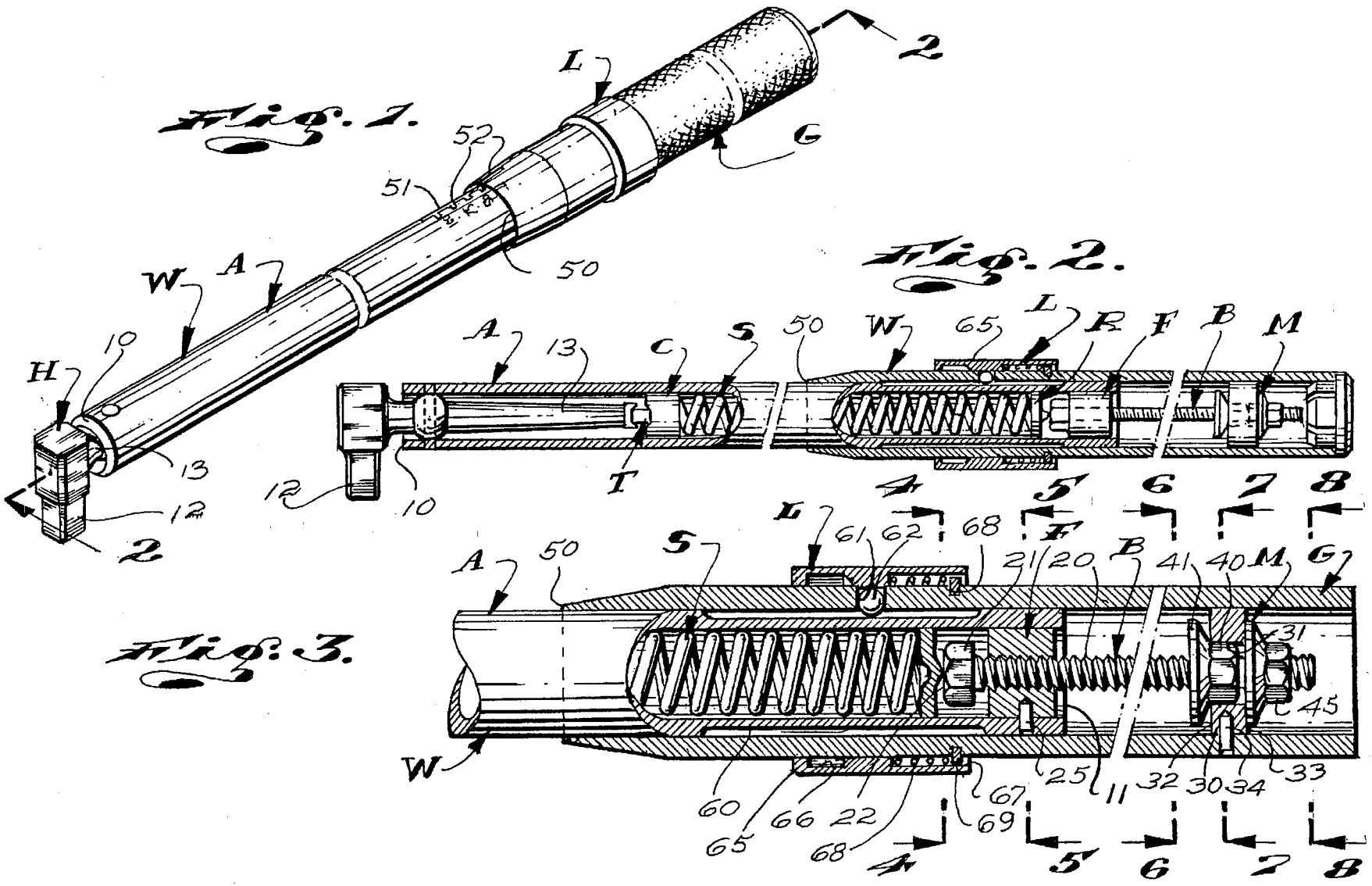
FIG. 1 is an isometric view of a wrench structure embodying the invention.
FIG. 2 is a longitudinal sectional view taken substantially as indicated by Line 2—2 on FIG. 1.
FIG. 3 is an enlarged sectional view of a portion of the structure shown in FIG. 2.
Figure 4:
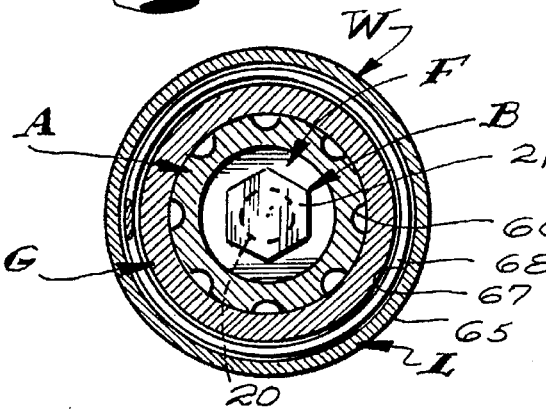
FIG. 4 is an enlarged sectional view taken substantially as indicated by Line 4—4 on FIG. 3.
Figure 5:
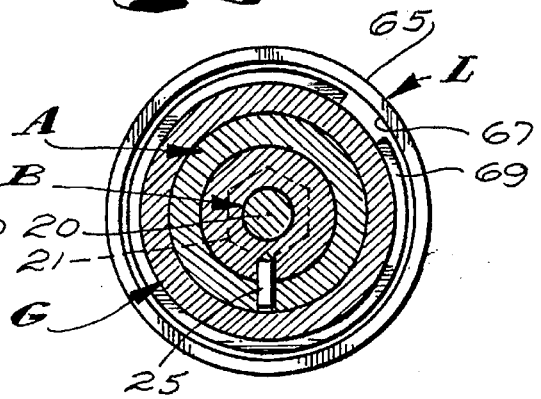
FIG. 5 is an enlarged sectional view taken substantially as indicated by Line 5—5 on FIG. 3.
Figure 6:
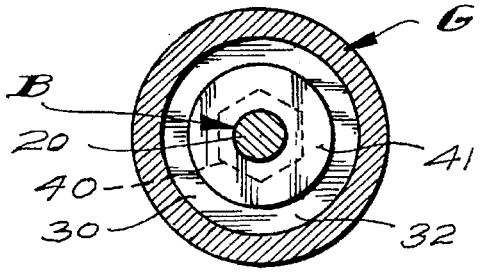
FIG. 6 is an enlarged sectional view taken substantially as indicated by Line 6—6 on FIG. 3.
Figure 7:
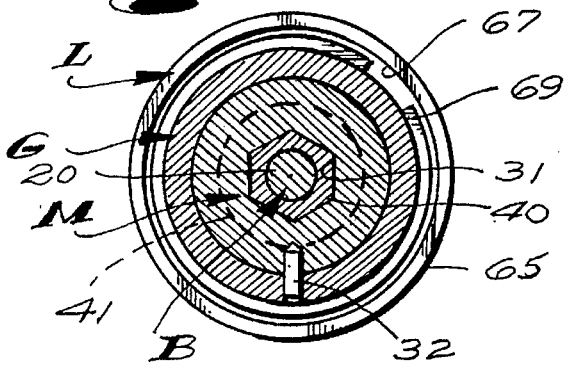
FIG. 7 is an enlarged sectional view taken substantially as indicated by Line 7—7 on FIG. 3.
Figure 8:
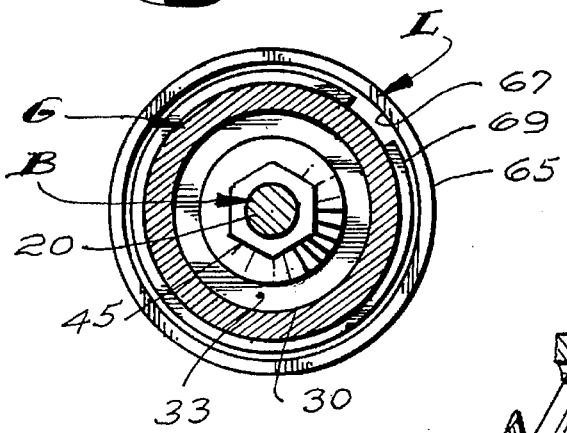
FIG. 8 is an enlarged sectional view taken substantially as indicated by Line 8—8 on FIG. 3.

FIGS. 1 and 2 of the drawings illustrate the whole of a torque wrench W embodying my invention.

The wrench W includes an elongate tubular lever arm A with front and rear ends 10 and 11; a tool-engaging head H pivotally mounted at the front end of the arm and including a laterally projecting polygonal drive part 12 and an elongate pivot arm 13 projecting freely rearwardly into the forward end portion of the arm A; a cylindrical plunger C slidably engaged in the lever arm in rearward spaced relationship from the rear end of the pivot arm; a trip block T with flat forwardly and rearwardly disposed faces normally establishing flat opposing engagement with flat rearwardly and forwardly disposed seats at the rear end of the pivot arm and at the front end of the plunger; an elongate helical compression spring S with front and rear ends positioned within the lever arm with its front end in pressure bearing engagement with the rear end of the plunger; a spring seat part R within the lever arm and engaged with the rear end of the spring; a threaded nut F in the arm rearward of the part R; and, an elongate screw machine part B with front and rear ends is within the lever arm and engaged through the nuts with its front end engaging the seat part R and movable longitudinally to adjust axial biasing of the spring.

The basic wrench structure described above is old art that characterizes the great majority of adjustable click-type torque wrenches provided by the prior art. All of that which occurs forward of the screw part B can be varied in design and construction without in any way departing from the broader aspects and spirit of my invention.

In accordance with the above, the present invention is limited to the means provided to adjust the wrench and that occurs rearward of the spring S and part R and that includes the machine screw part B.

In the wrench of the present invention, the screw part B is an elongate hex (hexagonal head) machine screw part that includes an elongate threaded shank 20 with front and rear ends and a hexagonal tool-engaging head 21 at the front end of the shank. The head has a flat forwardly disposed front end surface 22. Such machine screw parts are commonly called bolts. The screw part or bolt B is positioned centrally within the rear end portion of the arm A with the front surface 22 of the head in engagement with the spring seat part R which part is shown as a flat round disk with a forwardly disposed surface upon which the rear end of the spring S is seated and a central rearwardly projecting dimple that establishes a pivot point that opposes and bears against the center of the surface 22 of the bolt.

In practice, the bolt B is a standard or common, commercially available bolt the retail price of which is approximately 4-cents (four cents).

The forward end portion of the shank 20 of the bolt B is threadedly engaged through the bolt carrier nut F that is securely set within the rear end portion of the lever arm A. The nut F drivingly couples the bolt with the arm A. In the form of the invention now under consideration, the nut F is an internally threaded cylindrical nut slidably engaged in the lever arm A and set in position therein by at least one radially extending set screw or pin 25 that is engaged in a radial opening formed in the lever arm and in a registering socket opening formed in the nut.

The bolt carrier nut F is a small and extremely simple part that can be machined at little cost.

It will be apparent that upon selective rotation and resulting axial movement of the bolt B in the nut F the extent of axial biasing of the spring S can be varied and adjusted as circumstances require.

The rear end portion of the shank 20 of the bolt B projects freely rearwardly from the rear end of the lever arm A.

The rear end portion of the shank 20 of the bolt B is rotatably drivingly coupled with the rear end portion of an elongate tubular, manually engageable, hand grip G by a coupling means M. The hand grip G has a forward portion that is axially and rotatably slidably engaged about and supported by the rear end portion of the lever arm A and has a rear end portion that projects freely from rear end of the lever arm A and surrounds the rear end portion of the bolt B.

The coupling means M drivingly coupling the grip G with the bolt B includes an annular drive nut or ring 30. The drive ring 30 has a central axially extending polygonal (hexagonal) opening 31 and forwardly and rearwardly disposed front and rear surfaces 32 and 33. The ring 30 is engaged in the rear end portion of the hand grip G and is secured therein by two or more set screws or set pins 34 engaged in registering radial openings formed in the hand grip and the ring. The drive ring 30 is a small, simple and inexpensive to manufacture part.

The means M next includes a polygonal (hexagonal) drive nut 40 threadedly engaged on the shank 20 of the bolt B and is positioned in rotary driving engagement within the opening 31 in the ring 30.

The nut 40 is a flange-nut including a hexagonal body with front and rear ends and a radially outwardly projecting stop flange 41 about its front end of the body. The flange 41 overlies and stops against the front end surface 32 of the drive ring 30.

Finally, the means M includes a flanged nut 45 that is engaged on the rear end portion of the shank 20 and that is advanced forwardly thereon to move its flange 46 into tight pressure engagement with the rear surface of the drive ring 30 and operates to draw the drive nut 40 into tight pressure engagement with the ring 30. The nut 45 is a lock nut that functions to hold the nut 40 in rotary driving engagement in the ring 30 and releasably locks the shank 20 of the bolt B against rotation within the nut 40.

By selectively backing off or releasing the nut 45 from its locking position with the ring 30, the nut 40 can (by rotation of the grip G) be turned on the shank 20 of the bolt B to vary and/or adjust its position longitudinally of the shank 20 of the bolt and thereby effect calibrating the wrench, as circumstances might require.

The nuts 40 and 45 are standard, common, commercially available flange nuts that can be purchased for a fraction of a cent.

In accordance with common practices, and as shown in the drawings, the front end portion of the tubular grip G is tapered forwardly and radially inwardly to define a thin or fine scale reading edge 50 that is moved longitudinally of a longitudinally extending scale 51 impressed or otherwise applied to the exterior surface of the arm A, throughout that portion of the arm along which the edge 50 of the grip G moves when the grip is rotated to adjust the wrench. The scale 51 is calibrated to indicate those units of force that are required to actuate the wrench when the hand grip is in a multiplicity of positions longitudinally of the lever arm.

One or several circumferentially spaced calibration marks 52 are formed in the tapered surface of the grip G adjacent the edge 50, in accordance with common practices.

Also, in accordance with common practice, the tubular hand grip G is provided with a releasable lock means L that normally releasably holds the grip against rotation relative to the arm A and so that the wrench is not subject to being inadvertently or accidentally moved out of adjustment during normal use of the wrench.

In the case illustrated, the lock means L includes a plurality of circumferentially spaced, longitudinally extending grooves 60 formed in the exterior of that portion of the lever arm that occurs inward of the front end portion of the grip G.

The means L next includes a radial opening 61 in the grip G and a stop ball 62 in the opening 61. The ball 62 is greater in diametric extent than the wall thickness of the grip G and is movable radially in the opening 61 between a lock position where the ball projects inwardly from the sleeve and enters a groove 60 and a release position where the ball is moved radially out of engagement in a groove 60 and projects outwardly from the grip G.

The means L next includes a manually operable lock release sleeve 65 that is slidably engaged about the exterior of the grip to normally overlie the opening 61 and the ball 62 and that holds the ball radially inward in its lock position. The sleeve is formed with a radially inwardly opening annular channel 66 that normally occurs forward of the ball 62 and that overlies and allows the ball to move radially outward from its lock position to its release position when the sleeve is moved rearwardly, from a forward lock position to a rear release position.

Finally, the means L includes a radially inwardly and axially opening bore 67 in the release sleeve 65; an elongate helical compression spring 68 with front and rear ends engaged about the grip G and within the bore opening 67 in the sleeve 65 with its front end in stopped engagement with a shoulder in the sleeve defined by the bore. A radially outwardly opening annular groove 68 is formed in the grip G and a snap ring 69 is engaged in and projects radially from the groove. The snap ring engages the rear end of the spring 68.

The spring 68 normally yieldingly urges and holds the sleeve 65 in its forward locked position.

The above-noted locking means L is but one of several suitable forms of locking means that have long been used in adjustable click-type torque wrenches and is that form of lock means that the users of such wrenches have become most accustomed to.

Figure 9:
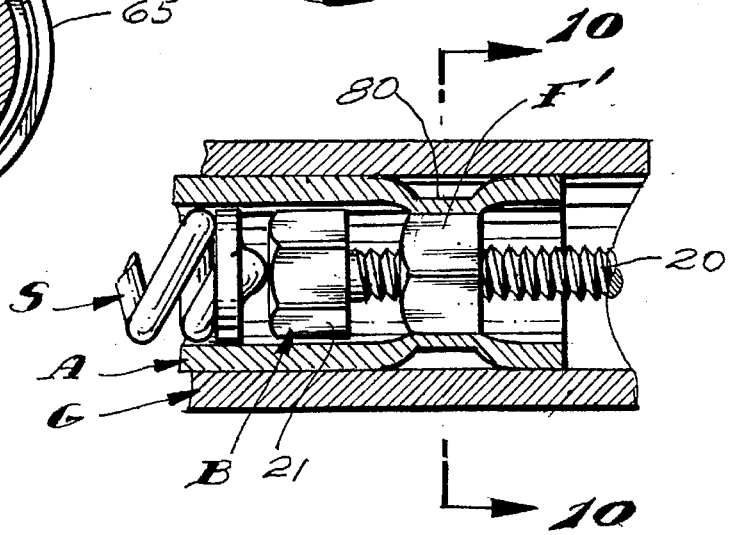
FIG. 9 is a longitudinal sectional view of a portion of another embodiment of the invention.
Figure 10:
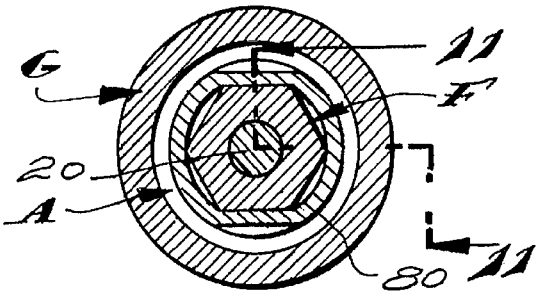
FIG. 10 is a sectional view taken substantially as indicated by Line 10—10 on FIG. 9.
Figure 11:
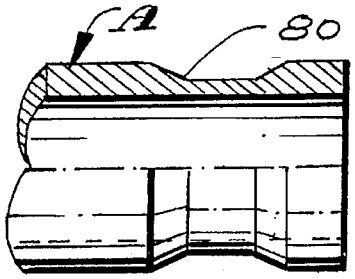
FIG. 11 is a view of a portion of the structure shown in FIG. 10 and taken as indicated by Line 11—11 on FIG. 10.

In FIGS. 9 through 11 of the drawings, I have illustrated another embodiment of my invention wherein the carrier nut F' is a standard, inexpensive, hexagonal nut that is slidably engaged into the open rear portion of the arm A. The portion of the arm A surrounding the nut F' is formed with a radially outwardly opening annular channel 80 to reduce the wall thickness of the arm adjacent the nut and that enables the wall portion of the arm adjacent to the nut to be pressed and formed radially inwardly into substantially flat bearing and stopped engagement with one or more flats of the nut, without adversely deforming the portions of the arm A that occur adjacent the channel 80.

The deformed portions of the arm engaging the flats of the nut can be induction or spot-welded with the nut.

With the above structure, the carrier nut F' is a standard nut the cost of which is a fraction of a cent. The nut F' replaces the specially made nut F provided in the first embodiment of my invention. In addition to the foregoing, the channel 80 in the arm A is formed coincidentally with machining of the groove 68 for the snap ring 69 and tapering of the forward end portion of the arm and is such that it can be easily, conveniently and quickly formed at negligible cost.

In addition to the foregoing, in this second embodiment of the invention, the drilling of registering openings and holes in the arm and nut and the engagement of set screws or pins therein, as is required in the first embodiment of the invention, is eliminated.

Figure 12:
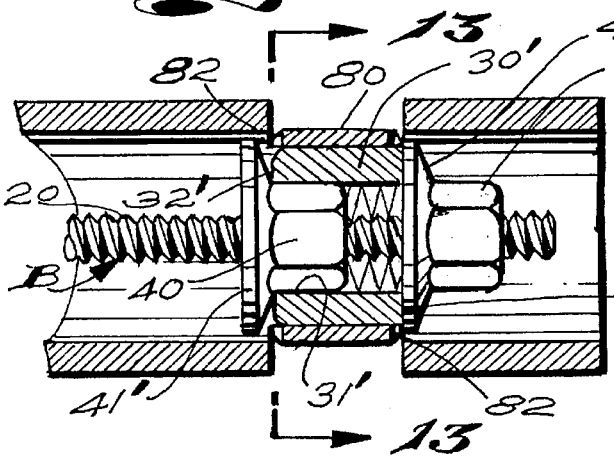
FIG. 12 is a longitudinal sectional view of another portion of another embodiment of the invention.
Figure 13:
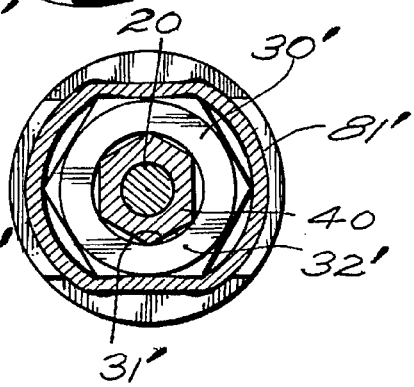
FIG. 13 is a sectional view taken substantially as indicated by Line 13—13 on FIG. 12; and, FIGS. 14 and 15 are end views illustrating a part of the structure shown in FIGS. 12 and 13 in two stages of manufacture.
Figure 14:
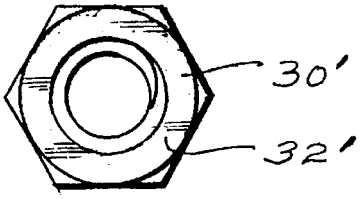
Figure 15:
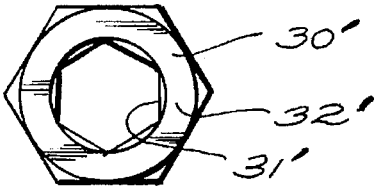

In this second embodiment of the invention and as shown in FIGS. 12 through 15 of the drawings, the ring 30' is a standard polygonal in cross-section nut with front and rear surfaces 32' and 33' and the threaded opening of which is broached (as illustrated in FIGS. 14 and 15 of the drawings) to substantial hexagonal form to establish a polygonal opening 31' to accommodate and establish rotary driving engagement with the drive nut 40. The ring 30' replaces the more costly ring 30 in the first embodiment of the invention. Since the material removed during broaching of the nut or ring 30' is the thread stock in the nut, the broaching operation requires little work and can be easily, quickly and economically performed.

In this second form of the invention, the ring 30' is slidably engaged in the rear end portion of the grip G; the grip G is formed with an annular channel 81'. The portion of the wall of the grip G in which the channel 81' is formed is pressed and deformed into engagement with one or more of the flats of the nut or ring 30'. Opposing abutting portions of the grip G and the nut 30' can be induction or spot-welded.

In practice and as shown in FIGS. 12 and 13 of the drawings, the wall of the grip, at each side of the channel 81' can be slotted, as at 82, at those portions of the channel that are to be deformed. Such slots greatly facilitate deforming of the grip to engage the ring 30'.

In practice, an annular band in the nature of a manufacturer's label is engaged in the channel 81 and obscures the work performed on the grip G'.

The wrench structures of the present invention, through the unique adoption and use of an inexpensive standard bolt and inexpensive nuts, that can be easily and quickly assembled without the exercise of special skill. The wrench structure can be manufactured at a price that is at least 20% less than the cost of manufacturing those comparable adjustable-type wrenches that are presently found in those channels of trade within the United States in which such wrenches are to be found. Accordingly, the wrench structures of the present invention can be manufactured and profitably sold in the United States at a price that, at present, is less than the prices that are now exacted for those comparable adjustable click-type torque wrenches, of foreign manufacture, that proliferate those channels of trade.

Having described only typical preferred forms and embodiments of my invention, I do not wish to be limited to the specific details herein set forth but wish to reserve to myself any modifications and/or variations that might appear to those skilled in the art and that fall within the scope of the following claims.

Having described my invention, I claim:

1. An adjustable click-type torque wrench structure comprising an elongate tubular lever arm with front and rear ends and a central longitudinal axis, a head pivotally mounted at the front end of the arm and including a laterally projecting tool-engaging part and an elongate pivot arm projecting freely rearwardly within the pivot arm; a flat rearwardly disposed front seat at the rear end of the pivot arm, an elongate plunger with front and rear ends slidably engaged in the lever arm rearward of the pivot arm; a flat forwardly disposed rear seat at the front end of the plunger, an elongate trip block with flat forwardly and rearwardly disposed faces normally establishing flat opposing engagement with said rearwardly and forwardly disposed seats, a spring seat part within the lever arm rearward of the plunger, an elongate axially extending helical compression spring within the arm in engagement with and between the plunger and the spring seat part; and, manually operable adjusting means to vary the axial biasing of the spring and including a standard machine bolt with an elongate axially extending threaded shank with front and rear ends and a polygonal tool-engaging head at the front end of the shank, the bolt is positioned in the lever arm with its head in engagement with the spring seat part and with the rear portion of its shank projecting from the rear end of the lever arm, a carrier nut which is a standard polygonal/hex machine nut, is positioned and securely set, within the rear end portion of the lever arm against axial and rotary movement relative thereto, and through which the shank of the bolt is threadedly engaged; manually operable drive means is provided to selectively rotate the shank within the carrier nut and includes an elongate tubular hand grip with a forward end portion rotatably carried by the arm and a rear end portion projecting rearward from the arm, an elongate drive ring with a central polygonal opening and front and rear ends is fixed within the rear end portion of the hand grip and through which the rear end portion of the shank freely projects, an elongate axially extending polygonal drive nut with front and rear ends and a radially outwardly projecting stop flange at its front end is threadedly engaged on the shank and is positioned in the ring in rotary driving engagement therewith and with its flange in stopped engagement with the front end of the ring; and, an elongate polygonal lock nut with front and rear ends and a radially outwardly projecting flange at its front end is engaged on the shank with its flange in pressure engagement with the rear end of the ring.

2. The adjustable click-type torque wrench set forth in claim 1 wherein the front end portion of the hand grip is axially and rotatably slidably engaged about the rear end portion of the lever arm, the hand grip has a forwardly disposed annular edge that is cooperatingly related with a longitudinally extending force-indicating scale on the lever arm.

3. The adjustable click type torque wrench setforth in claim 1 wherein portions of the arm adjacent radially outwardly disposed circumferentialy spaced flats of the carrier nut are formed radially inwardly into tight holding engagement with the flats.

4. The adjustable click type torque wrench setforth in claim 1 wherein portions of the hand grip adjacent circumferentially spaced radially outwardly disposed flats of the drive ring are formed radially inwardly into tight holding engagement therewith.

5. An adjustable click type torque wrench structure comprising an elongate tubular lever arm with front and rear ends and a central longitudinal axis, a head pivotally mounted on the front end of the arm and including a laterally projecting work engaging part and an elongate pivot arm projecting freely rearwardly within the lever arm; a flat rearwardly disposed from seat at the rear end of the pivot arm, an elongate plunger with from and rear ends slidably engaged in the lever arm rearward of the pivot arm; a flat forwardly disposed rear seat at the from end of the plunger, an elongate trip-block with flat forwardly and rearwardly disposed faces normally establishing flat opposing engagement with said rearwardly and forwardly disposed seats, a spring seat part within the lever arm and spaced rearward from the plunger, an elongate axially extending helical compression spring within the arm in engagement with and between the plunger and the spring seat part; and, manually operable adjusting means to vary the axial biasing of the spring and including a standard machine bolt with an elongate axially extending threaded shank with front and rear ends and a polygonal tool engaging head at the front end of the shank, the bolt is positioned in the lever arm with its head in engagement with the spring seat part and with the rear portion of its shank projecting from the rear end of the lever arm, a carrier nut is positioned and securely set within the rear portion of the lever arm against axial and rotary movement relative thereto and through which the shank of the bolt is threadedly engaged; manually operable drive means to selectively rotate the shank off the bolt within the carrier nut and including an elongate tubular hand grip with a forward end portion carried by the arm for rotary and axial movement relative thereto and a rear portion projecting rearward from the arm, an elongate drive ring that is a standard polygonal/hex machine nut with a broached central polygonal through opening and axially disposed front and rear ends, the drive ring is securely set within the rear end portion of the hand grip against rotary and axial movement relative thereto, the rear end portion of the shank freely projects through the drive ring, an elongate drive nut that is a standard ranged polygonal/hex nut with from and rear ends and a radially outwardly projecting flange at its front end is threadly engaged on the shank and in rotary driving engagement within the drive ring with its flange in stop engagement in the front end of the drive ring; and, an elongate lock nut that is a standard flanged polygonal/hex nut with front and rear ends and a radially outwardly projecting flange at its front end is engaged on the shank with its flange in pressure engagement with the rear end of the drive ring.

6. The adjustable click-type torque wrench set forth in claim 5 wherein the carrier nut is an elongate axially extending cylindrical part with a central threaded opening through which the shank is engaged, the carrier nut is engaged within the lever arm and is securely set therein against rotary and axial movement relative thereto.

7. An adjustable click type torque wrench structure comprising an elongate tubular lever arm with front and rear ends and a central longitudinal axis, a head pivotally mounted on the front end of the arm and including a laterally projecting work engaging part and an elongate pivot arm projecting freely rearwardly within the lever arm; a flat rearwardly disposed front seat at the rear end of the pivot arm, an elongate plunger with front and rear ends slidably engaged in the lever arm rearward of the pivot arm; a flat forwardly disposed rear seat at the front end of the plunger, an elongate trip-block with flat forwardly and rearwardly disposed faces normally establishing flat opposing engagement with said rearwardly and forwardly disposed seats, a spring seat part within the lever arm and spaced rearward from the plunger, an elongate axially extending helical compression spring within the arm in engagement with and between the plunger and the spring seat part; and, manually operable adjusting means to vary axial biasing of the spring and including a standard machine bolt with an elongate axially extending threaded shank with front and rear ends and a polygonal tool engaging head at the front end of the shank, the bolt is positioned in the lever arm with its head in engagement with the spring seat part and with the rear portion of its shank projecting from the rear end of the lever arm; a carrier nut that is a standard polygonal/hex machine nut is positioned and securely set in the rear end portion of the lever arm against axial and rotary movement relative thereto and through which the shank of the bolt is threadly engaged; a manually operable drive means to selectively rotate the shank of the bolt within the carrier nut and including an elongate tubular hand grip with a forward end portion engaged about the lever arm for rotary and axial movement relative thereto and a rear portion projecting rearward from the lever arm, an elongate drive ring that is a standard polygonal/hex nut with a broached central polygonal through opening and axially disposed front and rear ends, the drive ring is securely set within the rear end portion of the hand grip against rotary and axial movement relative thereto, the rear end portion of the shank freely projects through the drive ring, a drive nut that is a standard ranged polygonal/hex nut with front and rear ends and a radially outwardly projecting flange at its front end is threadly engaged on the shank of the bolt and in rotary driving engagement within the drive ring with its flange in stop engagement on the front of the drive ring; and, an elongate lock nut that is a ranged polygonal/hex nut with from and rear ends and a radially outwardly projecting flange at its from end is engaged on the shank of the bolt with its flange in pressure engagement with the rear end of the drive ring.

* * * * *

UNITED STATES PATENT AND TRADEMARK OFFICE

CERTIFICATE OF CORRECTION

PATENT NO. : 5,662,012

DATED : Sep. 2, 1997

INVENTOR(S) : Bosko Grabovac

It is certified that error appears in the above-identified patent and that said Letters Patent is hereby corrected as shown below:

Column 7, line 61, "pivot" should be --lever--.

Column 9, line 24, "ranged" should be --flanged--.

Column 10, line 39, "ranged" should be --flanged--;

line 40, "from" should be --front--.

Signed and Sealed this

Twenty-fourth Day of February, 1998

*Attest:*

*Attesting Officer*

Bruce Lehman

BRUCE LEHMAN

*Commissioner of Patents and Trademarks*